United States Patent [19]

West et al.

[11] Patent Number: 5,042,684

[45] Date of Patent: Aug. 27, 1991

[54] BAG-LESS BOX FOR FLOWABLE MATERIALS

[75] Inventors: Thomas West, Greenfield Center; Paul Jagielski, Loudonville, both of N.Y.

[73] Assignee: Georgia-Pacific Corporation, Atlanta, Ga.

[21] Appl. No.: 465,377

[22] Filed: Jan. 16, 1990

[51] Int. Cl.[5] ..... B65D 5/42; B65D 5/32

[52] U.S. Cl. ..... 220/443; 220/441; 220/418; 229/133; 229/125.19

[58] Field of Search ..... 220/443, 441, 416, 418; 229/133, 125.19, 144

[56] References Cited

U.S. PATENT DOCUMENTS

| | | | |
|---|---|---|---|
| 1,449,409 | 3/1923 | Hunt | 220/443 |
| 1,723,150 | 8/1929 | Gannon | 229/133 |
| 2,516,085 | 7/1950 | Williamson | 229/133 |
| 2,630,914 | 3/1953 | Bekoff | 229/125 |
| 3,036,752 | 5/1962 | Elliott | 220/441 |
| 3,084,845 | 8/1959 | Myers | 229/133 |
| 3,643,856 | 2/1972 | Jones | 220/441 |
| 3,744,702 | 7/1973 | Ellison | 220/443 |
| 4,177,935 | 12/1979 | Centanni | 220/443 |
| 4,260,071 | 4/1981 | Bamburg | 220/443 |
| 4,504,497 | 3/1985 | Kurth | 220/441 |
| 4,548,351 | 10/1985 | Gusic | 220/443 |
| 4,635,815 | 1/1987 | Grigsby | 220/443 |
| 4,657,177 | 4/1987 | Karabedian | 229/3.1 |
| 4,693,413 | 9/1987 | McFarland | 220/443 |

*Primary Examiner*—Stephen Marcus
*Assistant Examiner*—S. Castellano
*Attorney, Agent, or Firm*—Banner, Birch, McKie & Beckett

[57] ABSTRACT

A bag-less box for flowable materials constructed of a preferably single-wall outer covering, a preferably triple wall liner glued to the inner panel surfaces thereof, and a lid positionable on the outer covering when folded in and assembled. The outer covering is formed by cutting and folding a corrugated blank to define interconnected panels, top flaps and bottom flaps. Gusset fold areas are formed by diagonal through-cuts in the bottom flaps at flap corners adjacent the panels. With the gusset fold areas and the bottom flaps folded in, a self-sealing box bottom is defined such that a liner bag is not needed.

50 Claims, 6 Drawing Sheets

174
32
175
42
158
162
168
170
164
28
26
58
20
56
60
30
54
30
22
24
46
64

BAG-LESS BOX FOR FLOWABLE MATERIALS

BACKGROUND OF THE INVENTION

The present invention relates to bulk containers and particularly those adapted to hold one thousand or more pounds of flowable material.

Many different types of bulk containers adapted to hold large quantities of flowable material, such as polyethylene pellets, are known. One example is a four-ply corrugated box made from a double-wall inner liner laminated to a double-wall outer cover. An inner bag liner is provided in the box to prevent the flowable material from sifting out through openings in the bottom flaps and corners. Some container constructions require that the bottom flaps thereof be sealed as by tape, staples or the like. This adds an additional production step and also prevents the box when empty from being easily disassembled and folded generally flat for compact transport back to a loading location.

SUMMARY OF THE INVENTION

Accordingly, it is a principal object of the present invention to provide an improved bulk container design which securely contains, during rough shipment conditions, large amounts of flowable material without any leakage therefrom.

Another object of the present invention is to provide an improved corrugated bulk container construction which is easy and inexpensive to construct and assemble.

A further object of the present invention is to provide an improved bulk container which can, after a transport use and when empty, be easily disassembled and folded generally flat for transport back to a loading site.

A still further object of the present invention is to provide an improved bulk container which can hold at least one thousand pounds of flowable material securely with minimum if any outward bulging of its sides.

Another object is to provide a bulk container which can be easily and conveniently assembled with simple tools and skills.

A further object is to provide an improved corrugated bulk container construction with reduced paper shard contamination of the product contained therein.

A still further object is to provide an improved method of constructing corrugated boxes which reduces the paper shard residue which normally results from conventional corrugated slitters and press heads.

Directed to achieving these objects, a bag-less box for flowable materials is herein disclosed. The box is constructed from a single-wall outer covering, a triple wall liner and a lid. The outer covering is formed by cutting and folding a corrugated blank to define four serially-interconnected panels and top and bottom connected flaps extending out therefrom. The triple wall liner is glued to and covers the entire inside surfaces of the four panels. The first and third bottom flaps include triangular gusset fold areas at both corners adjacent the first and third panels and defined in part by diagonal through-cuts in these two flaps. With the gusset fold areas and the bottom flaps folded in, a leak-proof box bottom is thereby defined such that an inner liner bag is not needed. Tape, staples or the like are not required to seal the bottom flaps. After the flaps have been folded in and with flowable material filling the box thereby formed, the lid is fitted onto the box. Plastic straps are then wrapped around the box and the lid and the wooden pallet on which the box is supported. The flowable material in the box, with the straps wound thereabout, can be partially or entirely vacuumed out through a resealable opening in the top of the lid.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 7 is a bottom perspective view of the box of FIG. 1 showing the bottom thereof with the bottom flat panels and gusset areas shown being folded in.

DETAILED DESCRIPTION OF PREFERRED EMBODIMENTS OF THE INVENTION

Figure 1:
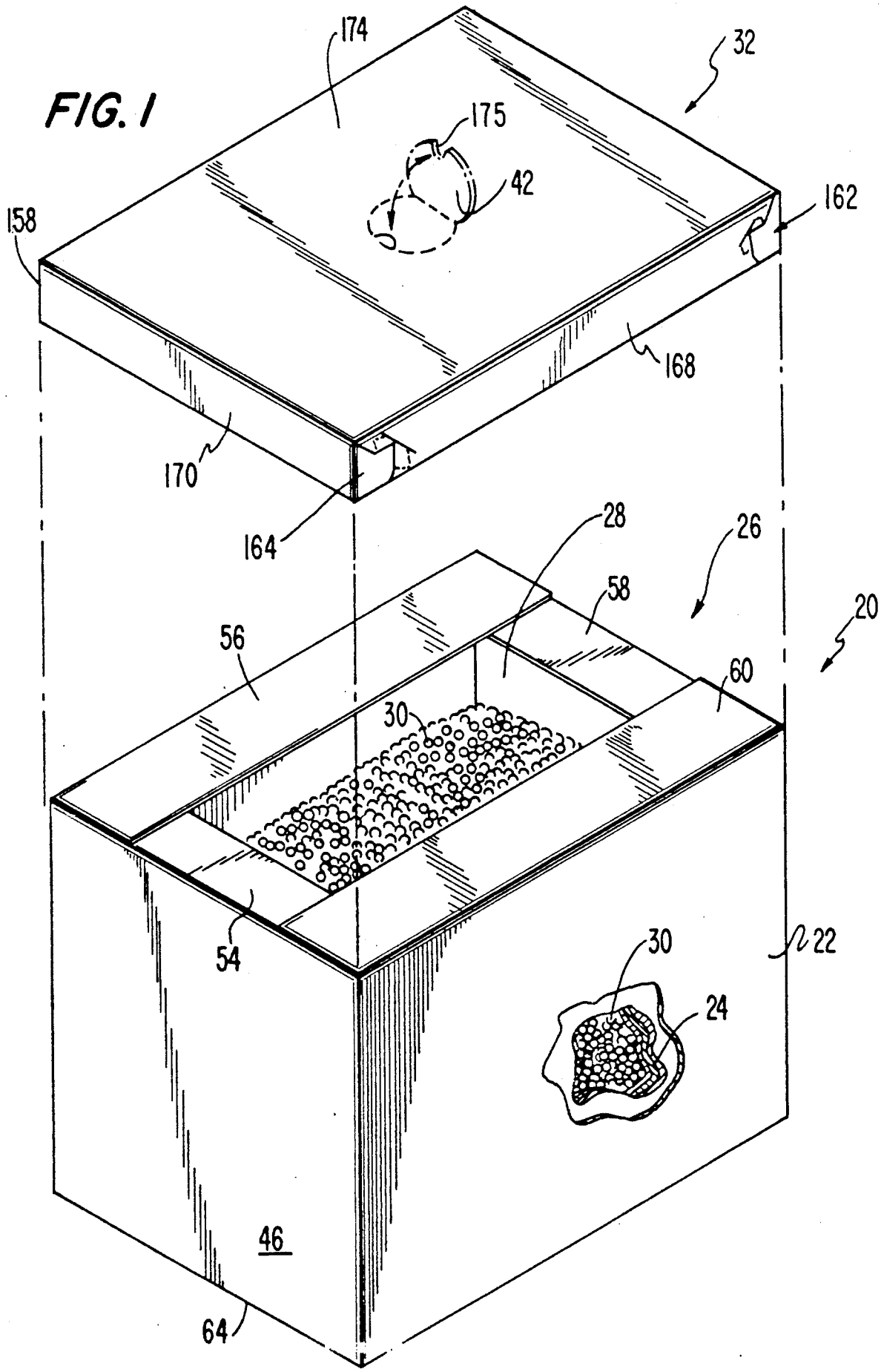
FIG. 1 is a perspective view of a bag-less of the present invention with the lid thereof shown in exploded relation and a portion of the side of the box broken away for illustrative purposes.

Referring to FIG. 1, a bag-less box of the present invention for flowable materials is illustrated generally at 20. Box 20 is constructed of a single wall outer covering shown generally at 22 and with a triple wall liner shown generally at 24 secured or laminated to the inside side surfaces of the outer covering. With the outer covering 22 and the triple wall liner 24 secured inside thereof and with the flaps folded, as will be discussed later, a rectangular container shown generally at 26 having an open top 28 is thereby formed. This open top container 26 can then be filled with the desired flowable material 30 through the open top 28; this flowable material 30, for example, can be one thousand or more pounds of polyethylene or other resin pellets. With the container 26 filled a separate corrugated lid shown generally at 32 is fitted thereon as can be understood from FIG. 1. Although the outer covering 22 consists preferably of only a single wall, multi-wall constructions are also within the scope of this invention. Similarly the liner 24, while is preferably constructed of three laminated layers, can be formed with one, two or four or more layers.

Figure 8:
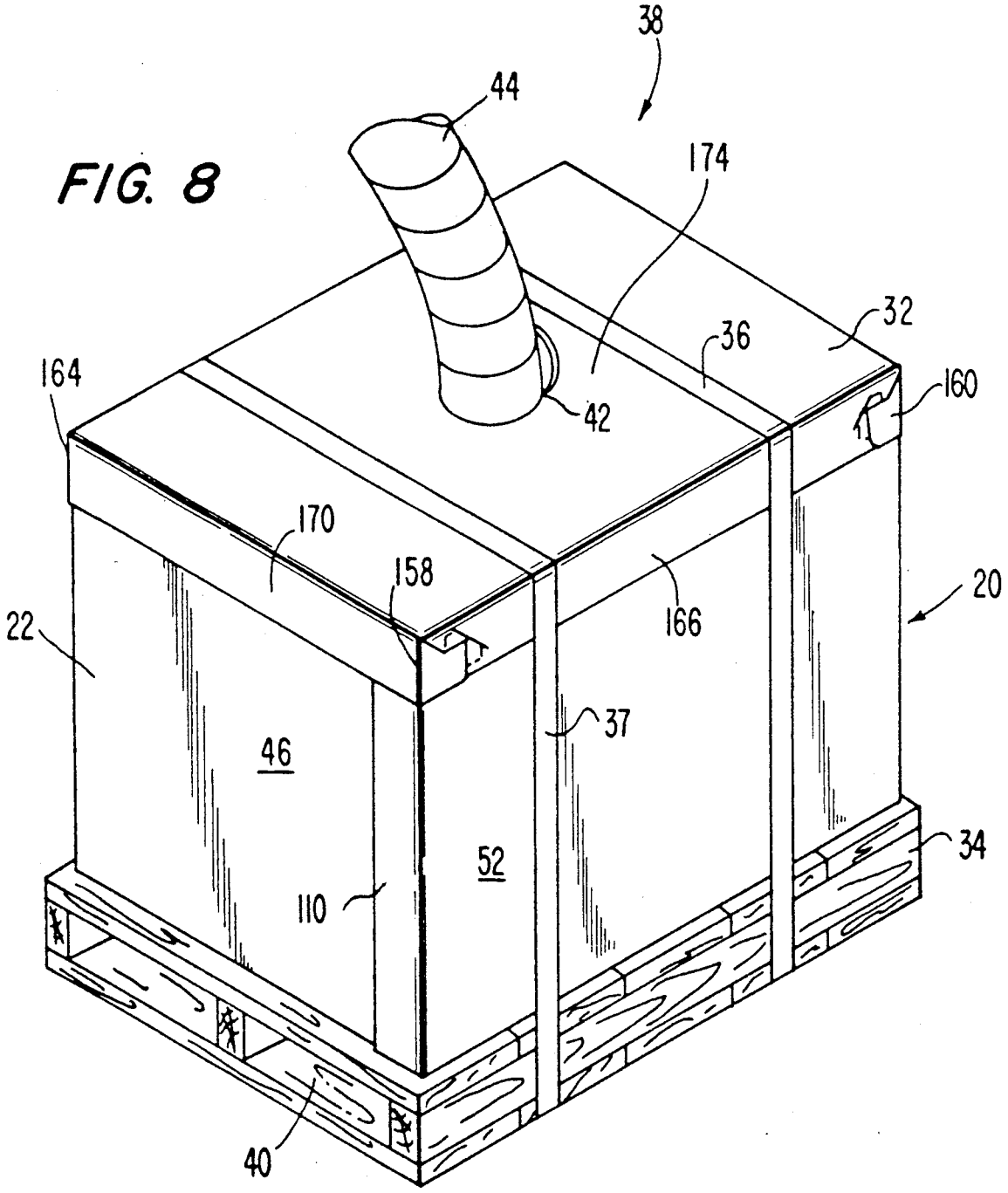
FIG. 8 is a perspective view of the box of FIG. 1 shown strapped to a pallet and with a suction hose secured thereto for removing the flowable material therein.

Referring to FIG. 8, the container 26, prior to filling with flowable material 30, is placed on a conventional wooden or plastic pallet as shown generally at 34. With the container 26 filled and resting on the pallet 34 and the lid 32 fitted on the top of the container, a pair of plastic straps 36, 37 can be banded around to secure not only the lid to the top of the container but also the container to the pallet and thereby define a box assembly designated generally by reference numeral 38. The pallet 34 forms a support base for the box 20 and also provides a means for forklift engagement through side or end openings 40 thereon. The box assembly 38 can thereby be securely and easily loaded and transported by air, truck, rail or the like. The pallet 34 thus provides structure rigidity and support for this heavy corrugated box which is often subjected to rough treatment during transport.

The container 26, even with the lid 32 secured thereon with the plastic straps 36, 37, can be easily unloaded as can be understood from FIG. 8. A releasable opening 42 formed in the top central location of the lid 32 is provided, and when opened a suction hose 44 can be inserted therein for removing all or some of the flowable material 30 from the container 26. The resealable opening 42 can then be resealed. It is further within the scope of this invention to provide an openable and closable plastic fixture (not shown) in the lid 32 in lieu of the resealable opening 42 for loading and unloading the container 26 therethrough with the lid 32 secured to the top of the container.

Figure 2:
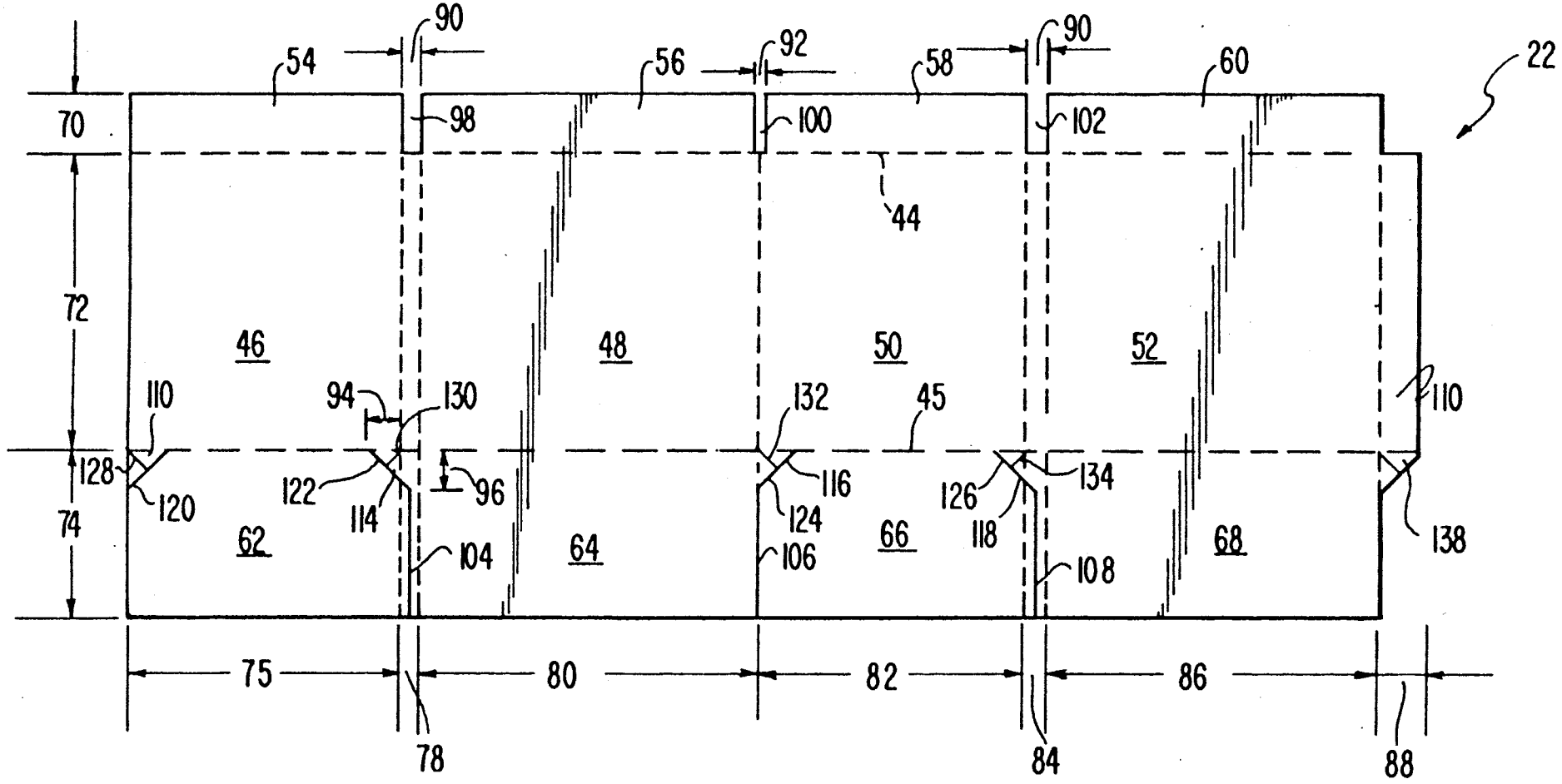
FIG. 2 is a plan view of the outer covering of the box of FIG. 1 shown in isolation and in a flat orientation.
Figure 4:
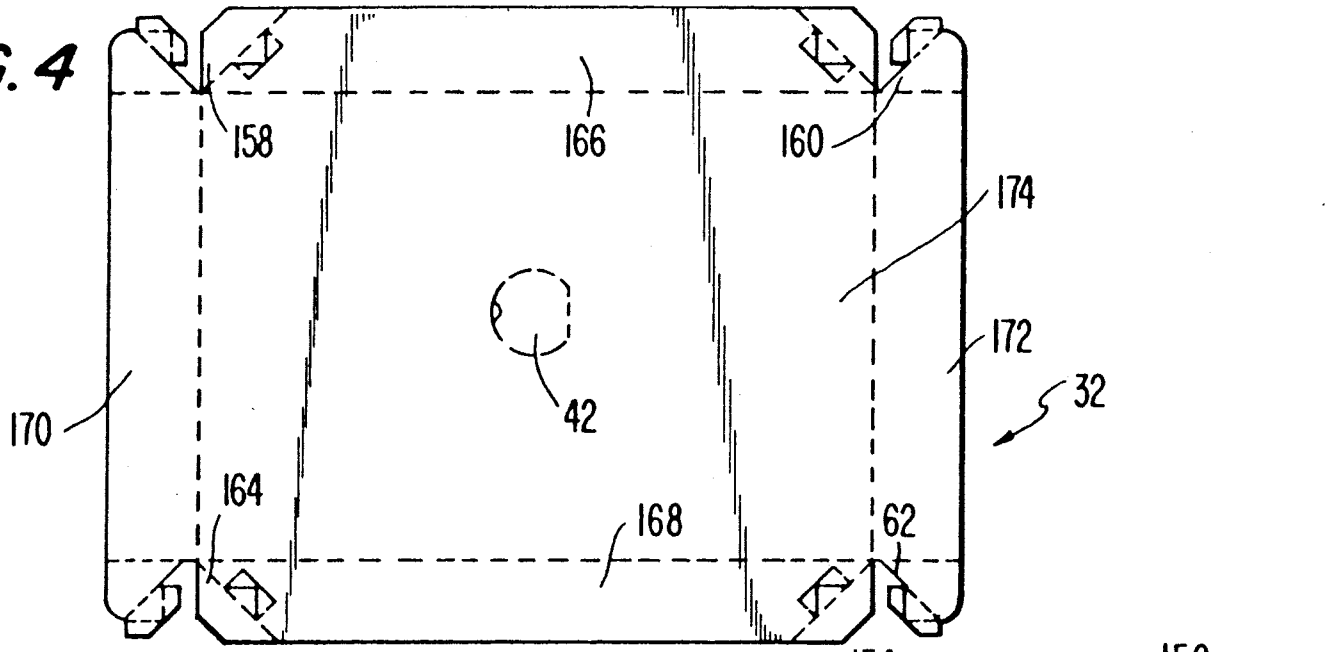
FIG. 4 is a plan view of the lid of the box of FIG. 1 shown in isolation and in a flat orientation.

The single-wall outer covering 22 is shown in isolation and in a folded flat position in FIG. 2. The covering 22 is formed from a laminated, corrugated two hundred and seventy-five pound test board or blank with a unique combination of cuts and folds. The fold lines 44, 45 are shown in FIG. 2 as dotted lines and have the necessary fold scorings required for ease of accurate folding assembly. The blank or covering 22 is formed as four serially-connected panels 46, 48, 50, 52 connected by one or two fold lines therebetween. Top flaps 54, 56, 58, 60 are connected at the tops of each of these panels and likewise bottom flaps 62, 64, 66, 68 at the bottoms thereof. A preferred configuration and dimensioning is defined by referring to the reference numerals in FIG. 2, as follows: distance 70 is 5"; 72 is $36\frac{3}{8}$"; 74 is $20\frac{1}{4}$"; 76 is $31\frac{1}{8}$"; 78 is $\frac{3}{4}$"; 80 is $39\frac{7}{8}$"; 82 is $31\frac{1}{4}$"; 84 is $\frac{3}{4}$"; 86 is $40\frac{3}{8}$"; 88 is 4"; 90 is $\frac{3}{4}$"; 92 is $\frac{1}{2}$"; 94 is $3\frac{5}{8}$"; and 96 is 4". Slots 98, 100, 102 are cut between adjacent top panels, and the bottom panels are separated by simple through-cut lines 104, 106, 108. A glue flap 110 extends out from the end panel 52. It is folded over onto panel 46 when the panels are properly folded and then glued thereto, as shown in FIG. 8, to hold the covering 22 in its box-like configuration.

At each of the upper corners of bottom flaps 62 and 66 triangular flap or web gusset areas 112, 114, 116, 118 are provided. They are formed by diagonal (straight or angled) through-cut lines 120, 122, 124, 126 extending from the sides of the flaps to the upper fold lines and with diagonal folds 128, 130, 132, 134, respectively, provided through the flaps. These triangular gusset fold areas 112, 114, 116, 118 allow the bottom flaps 62, 64, 66, 68 to be folded in and secured (by straps 36, 37) to prevent sifting of the material 30 out through the bottom of the container 26.

Figure 5:
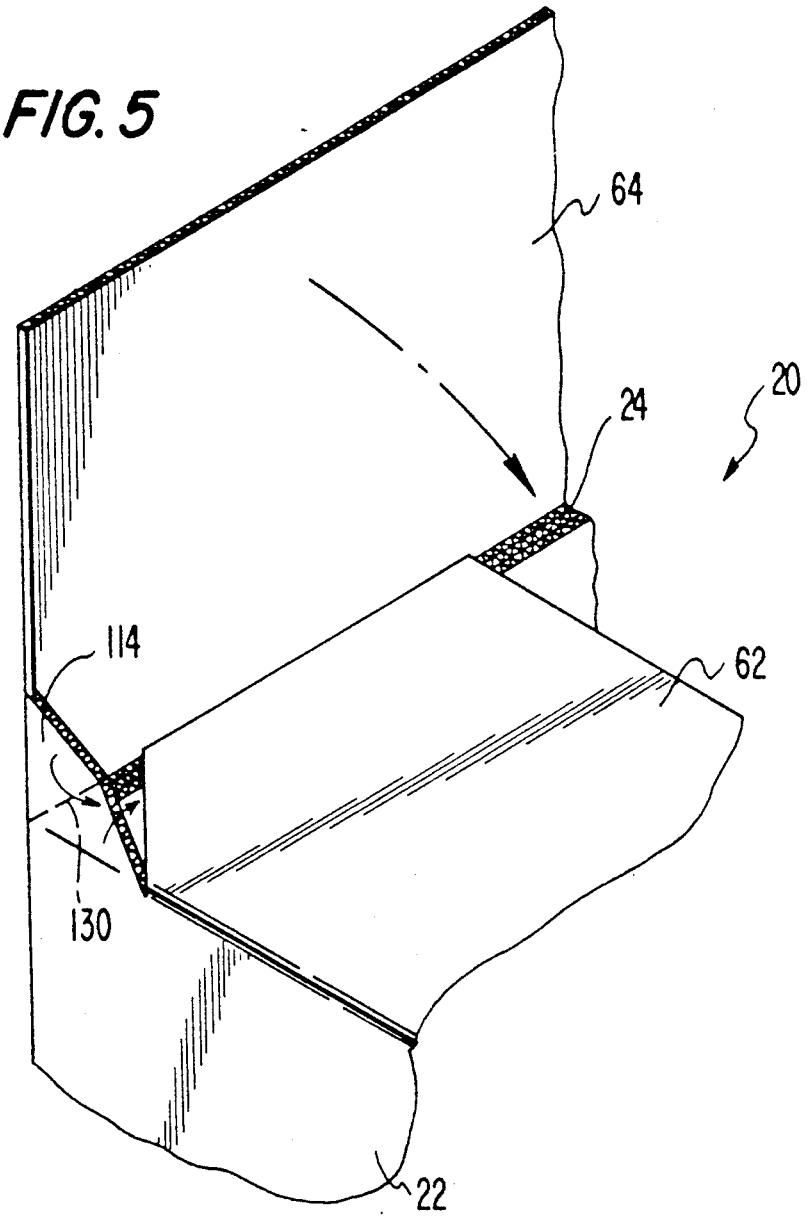
FIG. 5 is a perspective view of a bottom corner of the box of FIG. 1 illustrating a folding formation step of the present invention.
Figure 6:
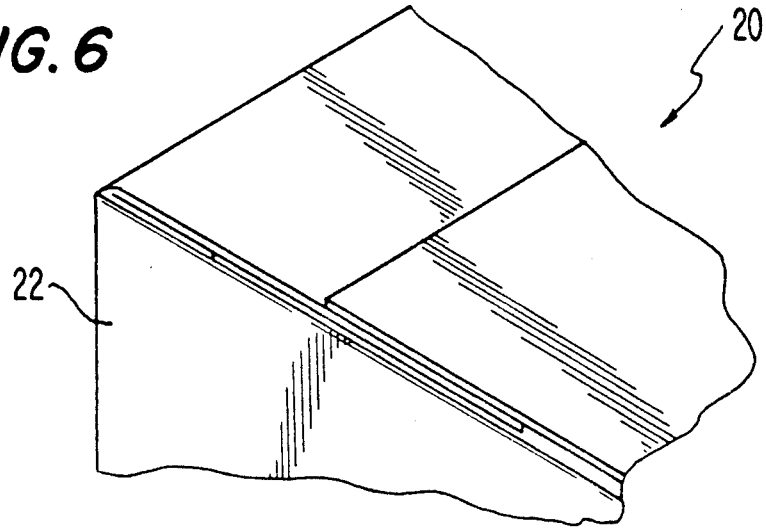
FIG. 6 is a view similar to that of FIG. 5 showing a folded box corner.
Figure 7:
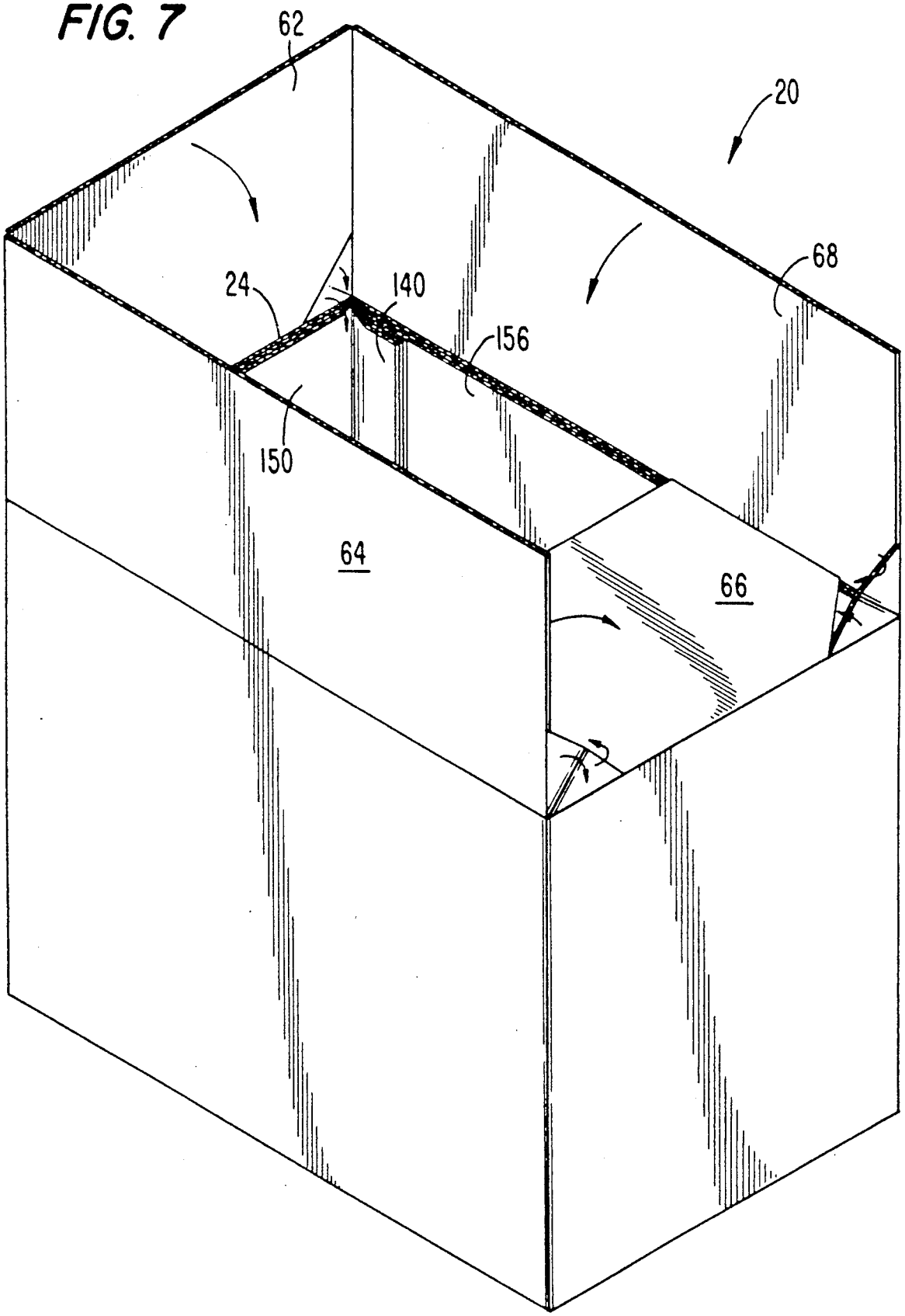

The folding procedure is illustrated in FIGS. 5–7. The flaps 62 and 66 are first folded in, the fold areas 112, 114, 116, 118 then folded in along their diagonal fold lines 128, 130, 132, 134, respectively, and the adjacent bottom flaps 64, 68 folded thereontop, as depicted in FIG. 6. The fold lines in the triangular flaps allow the flaps to fold onto themselves when the box 20 is assembled thereby sealing the bottom corners. The bottom flaps 64, 68 are sufficiently long so that the inner flaps 62, 66 when folded in meet at the centers of the length flaps 64, 68. The triangular gusset fold areas 112, 114, 116, 118 when properly folded therein secure each of the bottom corners of the container 26 in a self-sealing design and obviate the need for a liner (not shown) in the box 20. A similar triangular fold area 138 is provided at the bottom of the glue flap 110 as can be seen in FIG. 2. This unique bottom sealing structure contains the flowable material 30 in the container 26 without failure even in today's often rigorous shipping environments.

Figure 3:
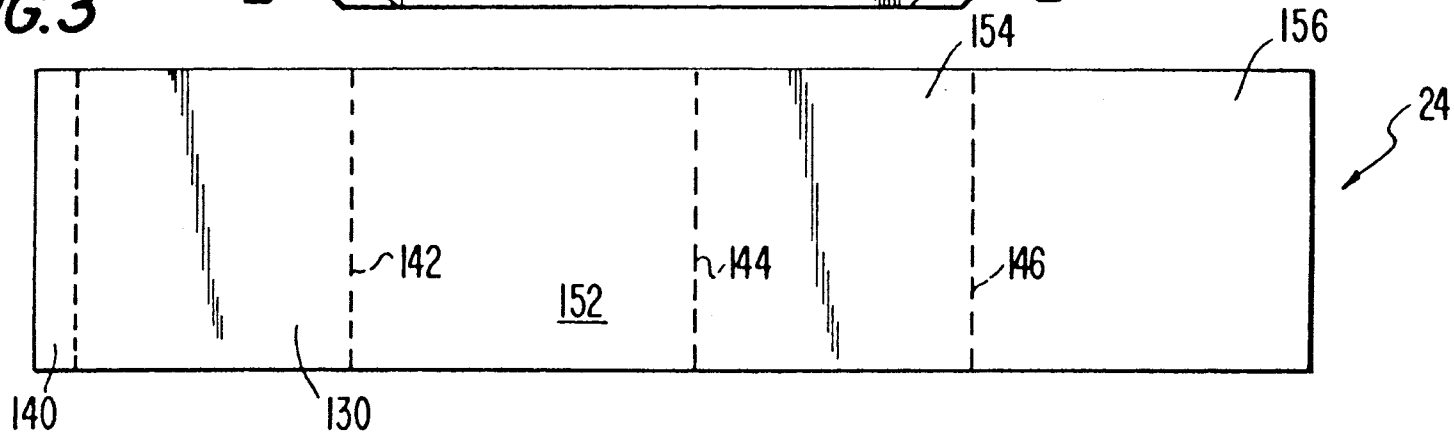
FIG. 3 is a plan view of the triple wall liner of the box of FIG. 1 shown in isolation and in a flat orientation.

The triple wall liner 24 is shown in a laid flat position in FIG. 3. It is formed with a triple walled corrugated, eleven-hundred beach test construction with a lap flap 140 extending out from one end thereof and with fold lines 142, 144, 146 defining four liner panels 150, 152, 154, 156. The lap flap 140 is glued to the inside of the panel 156 to form a rectangle, as can be seen in FIG. 7. This triple wall liner 24 is configured to cover and is glued to the entire inner surface areas of the panels 46, 48, 50, 52 between the fold lines 44 and 45 of the upper and lower flaps. The single-wall outer covering 22, together with the liner 24, is strong enough to contain the material 30 but is not so thick as to prevent the covering from being cut and effectively folded. The triple wall liner 24 provides the added strength to the box 20 to prevent side bulging or breakage when the container 26 is filled with one thousand or more pounds of flowable material 30. This construction complies with NMFC Package No. 248 which covers bulk plastics.

The triple-wall corrugated liner 24 and the corrugated outer covering 22 are slit preferably by a water jet slitter, and all cuts in the outer covering are made by a die-cut attachment to reduce product contamination by shards of the corrugated paper. These shards are a common residue with conventional corrugated slitters and press heads.

The lid or top cover 32 is shown in FIG. 3 in a laid flat position before folding assembly thereof. It is similarly made from a corrugated blank die press cut and folded. Each of the corners 158, 160, 162, 164 is configured to have a conventional tab and slot arrangement for folding the sides 166, 168 and ends 170, 172 down along their fold lines and securing them together in secure corner arrangements as seen in FIGS. 1 and 8, without the use of glue, staples or the like. The central area 174 of lid 32 is cut out to define the resealable opening 42 with a notch 175 for facilitating easy opening thereof. Other styles of lids or covers can also be used.

With the glue flap 110 and the lap flap 140 secured, the bottom and top flaps and the gusset areas folded out, and the straps 36, 37 removed, the lid 20 can be folded out flat and the container 26 can be folded in a space-saving nearly flat or accordian-like position having generally the width of two adjacent panels.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

What is claimed is:

1. A bagless-box for flowable materials, said box comprising:

an outer covering comprising a corrugated blank, said blank being formed to define first, second, third and fourth serially-connected rectangular panels, said panels being separated from one another along longitudinal panel fold lines, and each said panel having a panel top edge and an opposite panel bottom edge, first, second, third and fourth top flaps connected to said respective panel top edges along panel top edge fold lines, first, second, third and fourth bottom flaps connected to said respective panel bottom edges along panel bottom edge fold lines, and an attachment flap extending out from one of said panels and connected thereto by a flap fold line, said first and third bottom flaps each including a triangular gusset fold area at each corner adjacent said first and third panels and defined by diagonal through-cut lines in and extending entirely through said first and third bottom flaps; and a liner secured to inside surfaces of said first, second, third and fourth panels.

2. The box of claim 1 wherein said blank defines the outside side surfaces of said box.

3. The box of claim 1 wherein said blank, with said bottom flaps and said gusset fold areas folded in, is adapted to hold therein without any sifting at least one thousand pounds of flowable material.

4. The box of claim 1 further comprising a lid positionable on top of said outer covering when said first, second, third and fourth top flaps are folded in along said panel top edge fold lines.

5. The box of claim 4 wherein said lid comprises a corrugated member constructed separate from said corrugated blank.

6. The box of claim 4 wherein said outer covering, with said top flaps, said bottom flaps and said gusset fold areas folded in and said attachment flap attached to a different one of said panels than from said one panel from which said attachment flap extends, and said liner together define an open-top container.

7. The box of claim 6 further comprising securing means for securing said lid on top of and to said open-top container.

8. The box of claim 7 wherein said lid has opening means selectively openable, so that flowable material can be withdrawn from inside said open-top container out therethrough, and subsequently resealable closed.

9. The box of claim 4 wherein said lid is formed from a corrugated blank, cut and folded to define a lid top and lid sides connected thereto.

10. The box of claim 4 further comprising banding means for banding said lid on top of and to said outer covering.

11. The box of claim 10 wherein said banding means comprises a pair of plastic straps.

12. The box of claim 4 further comprising a pallet and securing means for securing said outer covering to said pallet.

13. The box of claim 12 wherein said securing means secures said lid to said outer covering.

14. The box of claim 13 wherein said lid has a resealable opening out through which flowable material can pass with said lid secured to said outer covering by said securing means.

15. The box of claim 1 wherein said attachment flap extends from said fourth panel, and said attachment flap is secured to an outside surface of said first panel.

16. The box of claim 15 wherein said attachment flap is glued to the outside surface of said first panel.

17. The box of claim 1 wherein said liner is glued to and covers an entire inside surface of each said first, second, third and fourth panels.

18. The box of claim 1 wherein said liner includes first, second, third, and fourth liner panels and a lap piece extending out from an end edge of said first liner panel and securable to said fourth liner panel.

19. The box of claim 1 wherein said gusset fold areas and said bottom flaps each has a constant thickness throughout its extents thereof and wherein said thickness of each said gusset fold area equals said thickness of said bottom flaps.

20. The box of claim 1 wherein each said gusset fold area has a diagonal fold line perpendicular to said through-cut lines.

21. The box of claim 1 wherein each said gusset fold area has one side thereof defined by one said panel bottom edge fold line and being foldable with respect thereto.

22. The box of claim 1 wherein each said bottom flap is formed as a separate rectangle along said bottom edge fold lines.

23. The box of claim 1 wherein each said top flap is formed as a separate rectangle along said panel top edge fold lines.

24. The box of claim 1 wherein said second and fourth bottom flaps define outer flaps and said first and third bottom flaps define inner flaps which are dimensioned so that when folded in meet at the centers of said outer flaps.

25. The box of claim 1 wherein said corrugated blank is slit by a water jet slitter and is cut by at least one die cut attachment.

26. The box of claim 1 wherein said liner is slit by a water jet slitter.

27. The box of claim 1 wherein said first and second top flaps, said second and third top flaps, and said third and fourth top flaps are each separated by slots therebetween, and said first and second bottom flaps, said second and third bottom flaps, and third and fourth bottom flaps are each separated by cut lines therebetween.

28. The box of claim 27 wherein said cut lines are each continuous at inner ends thereof with a different said diagonal through-cut line.

29. The box of claim 1 wherein each said top panel has the same width and each said bottom panel has the same width.

30. The box of claim 1 wherein said outer covering includes a triangular gusset fold area connected along one edge thereof to the bottom of said attachment flap and along an edge perpendicular to said one edge to one of said bottom panels.

31. The box of claim 1 wherein said liner comprises a triple wall liner.

32. The box of claim 1 wherein said outer covering comprises a single-wall outer covering.

33. The box of claim 1 wherein said outer covering comprises a double-wall outer covering.

34. The box of claim 1 wherein said liner comprises a multi-wall corrugated liner.

35. The box of claim 1 wherein said liner is laminated to said panels.

36. A container comprising a blank including:

a plurality of serially connected side panels forming sides for the container when assembled, each pair of adjacent side panels being separated by at least one longitudinal fold line; and a plurality of closure panels in general alignment with one another and attached to said side panels such that one said closure panel is attached to each side panel, each said closure panel being separated from said side panel to which it is attached by at least one lateral fold line, each closure panel defining a proximate edge contiguous with the lateral fold line of said closure panel and a distal edge remote from said proximate edge, each pair of adjacent closure panels being separated by a cut line extending completely through said blank across the entire length of said cut line, each said cut line having first and second segments, each said first segment extending from said distal edge to a medial position between said proximate and distal edges in a direction generally parallel to said longitudinal fold lines, and each said second segment extending from said medial position to said proximate edge in a different direction angularly oriented to said first segment.

37. The container of claim 36 in which said closure panels further include first and second closure panels alternately oriented with respect to one another and in which each said closure panel defines a central axis oriented in a direction substantially parallel to said first segment of said cut line, wherein said second segment of each cut line is directed to extend generally toward said central axis of an adjacent one of said first closure panels as it extends from said medial position to said proximate edge.

38. The container of claim 37 in which said second closure panels further include corner fold lines, wherein each said corner fold line intersects said second segment of one of said cut lines and extends generally orthogonally thereto to said lateral fold line separating said second closure panel from its attached side panel.

39. The container of claim 38 in which said side panels are oriented to form an enclosure when assembled, and in which when assembled said closure panels are oriented generally orthogonally with respect to said side panel to which it is attached so that each said closure panel overlaps with its adjacent closure panels.

40. The container of claim 39 in which said second closure panels are folded along said corner fold lines such that portions of said second closure panels immediately adjacent said second segment of said cut lines are folded underneath said remaining portions of said second closure panels when assembled.

41. The container of claim 40 in which each said side panel defines an inside surface oriented on the interior of said container when assembled, and in which said container further includes a liner attached to said inside surfaces of said side panels to reinforce said container.

42. The container of claim 37 in which said first closure panels are folded inwardly relative to said second closure panels when the container is in its assembled orientation.

43. The container of claim 36 in which each said side panel defines an inside surface oriented on the interior of said container when assembled, and in which said container further includes a liner attached to said inside surfaces of said side panels to reinforce said container.

44. A container comprising a blank having an inner surface and an outer surface, said inner surface defining an interior of said container when assembled and said outer surface defining an exterior of said container when assembled and wherein said blank has a generally uniform thickness, said blank further including:

a plurality of serially interconnected side panels, each said side panel being separated from adjacent side panels by at least one longitudinal fold line, said side panels forming sides of the container when assembled;

a plurality of closure flaps, each said closure flap being attached to one of said side panels, each said closure flap being separated from its attached side panel by a lateral fold line, said closure flaps defining an end of the container orthogonal to said sides thereof;

a plurality of gussets, each said gusset being positioned adjacent a pair of said closure flaps and one of said lateral fold lines, each said gusset including a medial fold line defining said gusset into a first segment and a second segment, each said gusset being positioned in a corner of said container when assembled such that the outer surfaces of each said gusset are placed into abutting relationship with each other to seal the corners of the container against leakage of material placed in the container, wherein adjacent ones of said closure flaps are separated by first cut lines extending generally parallel to said longitudinal fold lines, wherein each said gusset is triangular in shape and defined by a second cut line angularly oriented in a non-parallel relationship to one of said first cut lines, one of said lateral fold lines, and an auxiliary fold line extending generally parallel to one of said longitudinal fold lines, and wherein said first and second cut lines extend entirely through said thickness of said blank.

45. A container comprising a blank including:

a plurality of side panels serially interconnected and in general alignment with one another, each said side panel being separated from adjacent side panels by at least one longitudinal fold line;

a plurality of closure flaps in general alignment with one another, said closure flaps each defining first and second opposite edges, said closure flaps each further being attached to one of said side panels along said second edge, each said attached closure flap and side panel being separated by a lateral fold line, said closure flaps being separated from one another by cut lines; and a plurality of corner gussets positioned adjacent said lateral fold lines, each said gusset having a generally triangular configuration defined by one of said lateral fold lines, a free edge which extends between one of said cut lines and one of said lateral fold lines, and a fold line in general linear alignment with one of said longitudinal fold lines, each said gusset defining a corner fold line which extends between its free edge and its lateral fold line in a direction generally orthogonally oriented relative to said free edge, and wherein said blank defines a generally uniform thickness and in which said free edge of each said corner gusset includes the entire thickness of said blank and the entire thickness of said free edge is completely severed.

46. The container of claim 45 further including a side tab attached to one of said side panels for facilitating the assembling of said side panels into an enclosure.

47. The container of claim 46 further including an additional gusset fixed to an end of said side tab adjacent one of said closure flaps, wherein said additional gusset has a generally triangular configuration and defines a free edge and a corner fold line which extends between its free edge and one of said lateral fold lines.

48. The container of claim 45 in which said gussets are folded inward along said corner fold lines when said container is assembled such that each said gusset underlies one of said closure flaps.

49. The container of claim 45 in which said blank defines an inside surface and an outside surface, and in which each said gusset includes a first portion and a second portion separated by said corner fold line, wherein said inside surfaces of said side panels form an interior of said container when assembled, and wherein said outside surfaces of said first and second portions of said gussets are engaged against one another when said container is assembled.

50. The container of claim 49 further including a liner having four serially interconnected liner panels separated by fold lines, said liner panels being affixed to said inside surfaces of said side panels for reinforcement of said container.

* * * * *